US005826593A

United States Patent [19]

Haubrich

[11] Patent Number: 5,826,593

[45] Date of Patent: Oct. 27, 1998

[54] HAIR RETAINER

[76] Inventor: Joan M. Haubrich, 2165 Hillcrest Dr., Duluth, Minn. 55811

[21] Appl. No.: 857,094

[22] Filed: May 15, 1997

[51] Int. Cl.[6] ..... A45D 24/04

[52] U.S. Cl. ..... 132/128; 132/126; 132/273; 132/275; 2/174

[58] Field of Search ..... 132/126, 127, 132/128, 146, 273, 212, 275, 219, 144; D28/39, 40, 41; 2/174, 207, 171, 170

[56] References Cited

U.S. PATENT DOCUMENTS

| | | | |
|---|---|---|---|
| D. 131,600 | 3/1942 | Holden | 86/10 |
| D. 158,103 | 4/1950 | Kuenstner | 86/10 |
| D. 167,553 | 8/1952 | Behr | 86/10 |
| D. 221,115 | 7/1971 | Solomon | 86/10 |
| D. 292,030 | 9/1987 | Reyson | D28/41 |
| 537,542 | 4/1895 | Moore . | |
| 889,873 | 6/1908 | Damon | 132/126 |
| 913,369 | 2/1909 | Fedel | 132/126 |
| 953,587 | 3/1910 | Bond, Jr. | 132/126 |
| 971,519 | 10/1910 | Brannen . | |
| 2,386,682 | 10/1945 | Heineman | 132/128 |
| 2,668,547 | 2/1954 | Wille | 132/46 |
| 2,805,673 | 9/1957 | Solomon | 132/47 |
| 2,945,500 | 7/1960 | Bolinger | 132/47 |
| 3,099,271 | 7/1963 | Dubelier | 132/46 |
| 3,301,266 | 1/1967 | Hoffmann | 132/46 |
| 5,301,696 | 4/1994 | Revson | 132/273 |
| 5,379,782 | 1/1995 | Tabb | 132/275 |
| 5,690,128 | 11/1997 | Grimes | 132/128 |

FOREIGN PATENT DOCUMENTS 768522 of 1934 France .

*Primary Examiner*—Gene Mancene
*Assistant Examiner*—Pedro Philogene
*Attorney, Agent, or Firm*—Haugen & Nikolai, PA

[57] ABSTRACT

The present invention is a decorative hair retainer for persons having mid-to long hair styles. It consists of an annular decorative fabric tube containing an elastic band in the interior thereof. Two combs are located on the exterior periphery of the annular fabric tube. The combs are positioned 180° apart from each other. In use, the accessory is secured on top of the gathered hair or alternatively the hair is gathered into a bunch and inserted through the center opening of the annular fabric tube member. The combs are then used to further secure the hair retainer to the head by being inserted into the hair between the hair retainer and the scalp of the individual wearing the hair retainer.

6 Claims, 2 Drawing Sheets

HAIR RETAINER

I. FIELD OF THE INVENTION

The present invention relates to a hair accessory and more particularly to a holder for retaining hair in a desired arrangement.

II. BACKGROUND OF THE INVENTION

A variety of hair accessories are used to assist in hair styling. Devices such as ribbons, bows, elastic bands, barrettes, and head bands are commonly used for holding hair in a desired arrangement. However, each of these accessories has limitations. Ribbons and bows generally are made from a smooth slippery cloth material such as satin and silk. Hair does not stay retained with such ribbons and/or bows, especially when the wearer is engaged in sports, dancing or similar activities. Elastic bands used for holding "ponytails" or the ends of braided hair often damage the hair. The repeated twisting of the bands around the hair, result in hair breakage. Elastic bands tend to pull hair out when the bands are being removed or tightened. When a person with long hair is involved in sports, the elastic band does not always keep the hair in place, with the hair falling out or breaking off. Barrettes or combs are limited in the amount of hair they can retain. Like elastic bands, barrettes and combs can damage and break hair through repeated use. Furthermore, barrettes and combs often have smooth surfaces that do not grip and hold hair securely.

Other hair retaining accessories comprise a band of cloth material around the elastic band to prevent the damage to the hair commonly caused by the elastic band. However, the smooth material surrounding the band will not necessarily keep hair within the band, especially when the wearer is physically active. The hair tends to fall or the band of material can slide out of position, defeating the purpose of this type of hair retainer.

What is needed is a hair accessory which will prevent damage to the hair from an elastic band, yet securely retain the hair in the desired arrangement. The present invention addresses these problems by providing an endless elastic band covered with an endless cloth tube to which two combs are secured. The combs are substantially hidden from view when in use but help maintain the material covered elastic band in position on the wearer's head. The combs also assist in maintaining the hair arrangement in place and the tension of the elastic, in turn, maintains the two combs in place.

SUMMARY OF THE INVENTION

The present invention consists of a tube of cloth material shaped into an annular band and surrounding a band of elastic tape. The cloth material may be larger than the elastic band and bunched or gathered to create an attractive look. Two combs are glued or otherwise affixed to the exterior of the annular cloth band at opposed end points when the band is stretched. That is to say, the two combs are preferably located 180° from each other on the cloth band. The combs are secured to the endless band so that the teeth of the combs are oppositely directed when secured to the band.

In use, the hair is gathered with each comb from each side of the head, gathering the hair at the back of the head to lay loosely and securing the hair away from the face. The material tube lies over the gathered hair and not through the tube of material. The cloth band is twisted several times before securing the combs in place to obtain proper grip and desired bow effect at back of head. In an alternative arrangement, the hair is gathered and pulled through the cloth band, the cloth band may be twisted several times to obtain the proper grip around the hair and the combs are then inverted so that their teeth point toward one another and when so oriented they can be inserted between the scalp and the center of the gathered and retained hair.

A primary object of the present invention is to provide a hair accessory which will securely hold hair in a desired arrangement without damaging the hair over prolonged periods and during athletic activities.

Another object of the present invention to provide a hair accessory which combines an elastic band, a decorative sheath and a pair of hair combs to anchor the hair accessory properly in the hair with the hair accessory being useable in a variety of hair styles such as a ponytail, french roll or french braid, etc.

A further object of the present invention is to combine a cloth material covered elastic band with hair combs where the combs are used to secure the elastic band in position in the hair in such a way that combs are hidden from view.

DESCRIPTION OF THE DRAWINGS

The foregoing features, objects and advantages of the invention will become apparent to those skilled in the art from the following detailed description of the preferred embodiment, especially when considered in a conjunction with the accompanying drawings in which.

DETAILED DESCRIPTION OF THE PREFERRED EMBODIMENT

Figure 1:
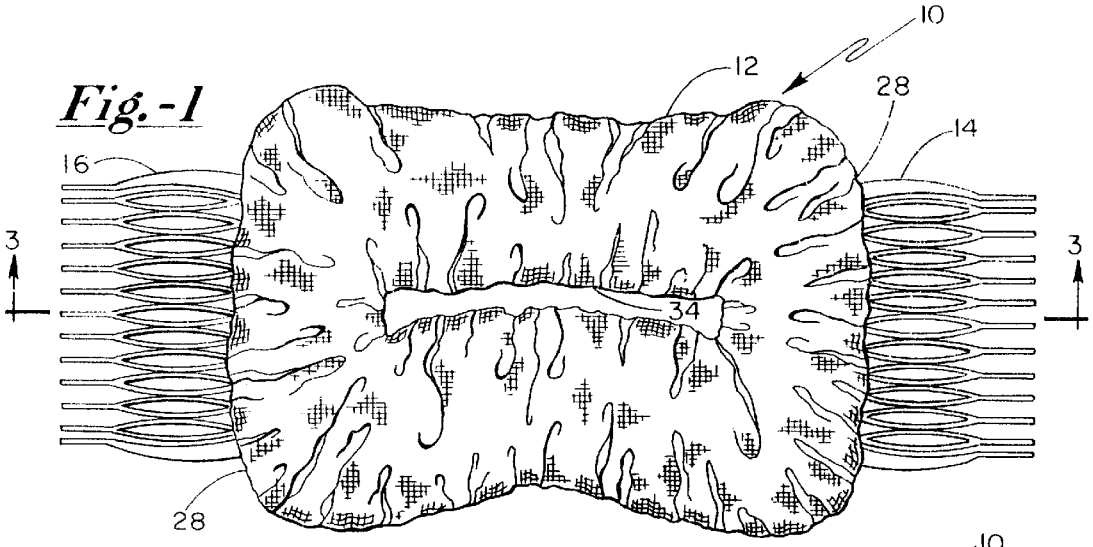
FIG. 1 is a front elevational view of the present invention.
Figure 2:
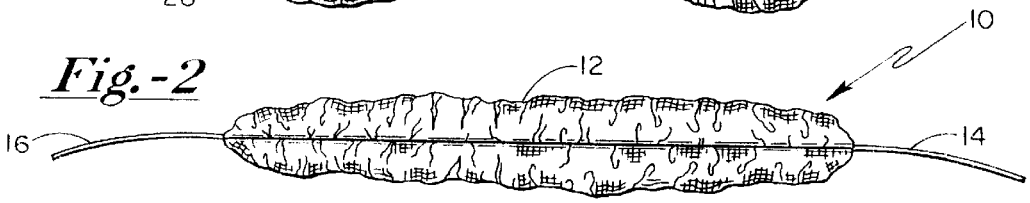
FIG. 2 is a side elevational view of the present invention.

The present invention is a hair retainer, designated 10 in FIG. 1. The hair retainer 10 consists of annular shaped tubular cloth band 12 with two opposing combs 14 and 16 extending from the tubular annular annular shaped tubular cloth band 12. Annular shaped tubular cloth band 12 is formed from a strip of material cloth preferably 31 inches long and 4½ inches wide first formed into a tube, preferably 2⅛ inches wide and then joined at its opposed ends. The cloth is preferably a cotton-based material or cotton/lycra/spandex-type of cloth. The material can be selected for everyday use or it may be a velvet or silk material for more formal occasions. Countless cloth types, colors and patterns are available for coordinating the hair retainer with the wearer's clothing.

Figure 3:
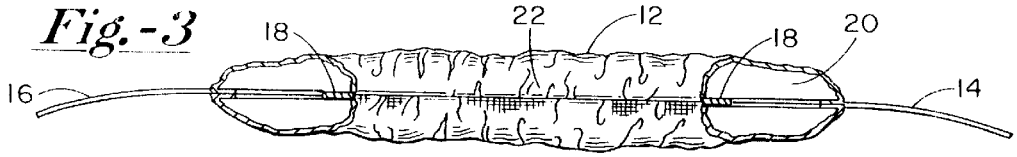
FIG. 3 is a cross-sectional view taken along line 3—3 of FIG. 1.
Figure 4:
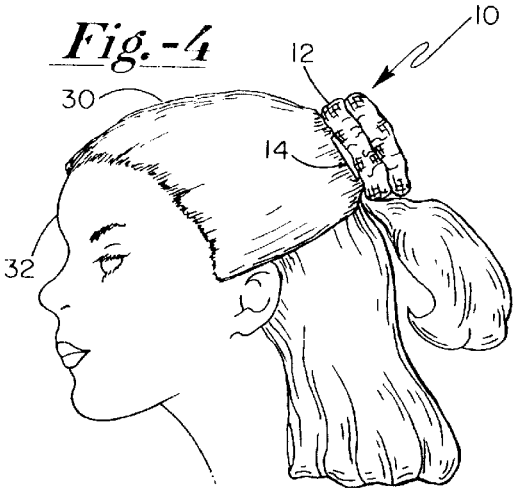
FIG. 4 is a front elevational view of the present invention fastened to a user's hair with the hidden portion shown in hidden view.
Figure 5:
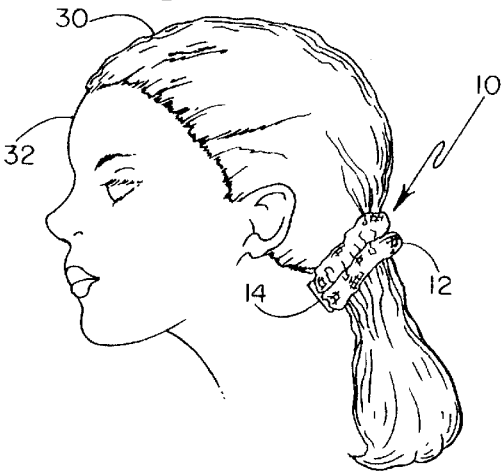
FIG. 5 is a side elevational view of the present invention fastened in a user's hair style.
Figure 6:
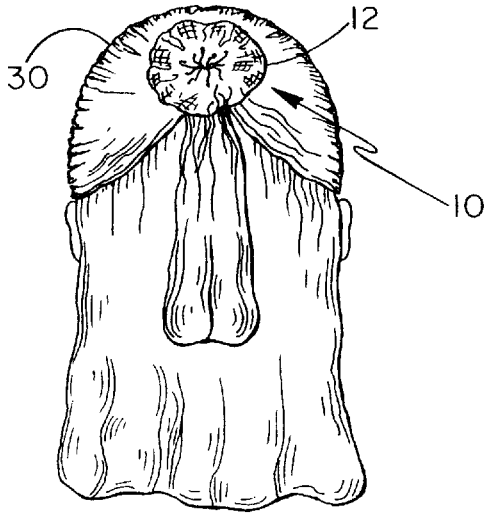
FIG. 6 is a rear view showing the present invention fastened in a user's hair style.

An elastic band 18 is located in the interior 20 of the annular shaped tubular cloth band 12 as shown in FIG. 3. The elastic band 18 is preferably located near the inner smaller diameter surface 22 of the annular shaped 12. The annular shaped tubular cloth band 12 may be longer than the elastic band to give a preferably gathered, bunched or full appearance. The elastic band 18 member is preferably about 11 inches in length and the fully stretched length of the annular member shaped tubular cloth band may preferably be about 15 inches long.

Two arcuate combs 14 and 16 are preferably positioned 180° from each other on the outer peripheral surface 28 of the annular shaped tubular cloth band 12 with their teeth pointing in opposite directions. The combs 14 and 16 are secured on the exterior of the annular shaped tubular cloth band 12 with an adhesive or other suitable anchoring mechanism as seen in FIG. 3. The combs 14 and 16 are preferably made of a clear material or they may be color coordinated for the individual's hair color or the color of the cloth forming the tubular cloth band 12.

The hair retainer 10 used in the hair by first gathering the hair 30 of each comb from each side of the head securing the hair away from the face 32, as seen in FIGS. 4–8.

Figure 7:
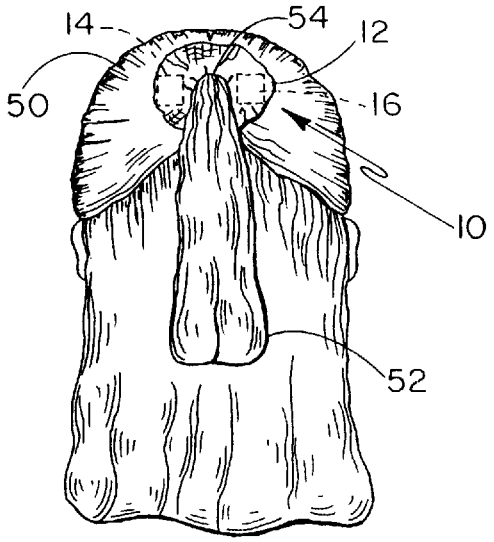
FIG. 7 is a rear view of the present invention fastened in an alternative manner in a user's hair style.
Figure 8:
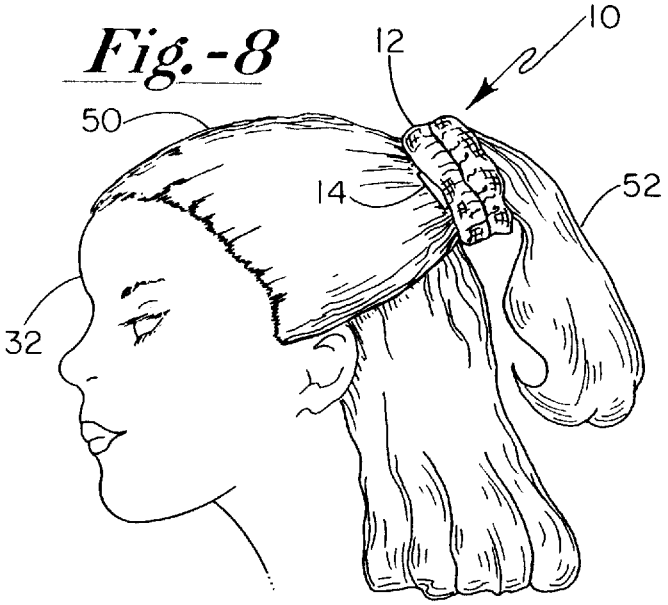
FIG. 8 is a side view of the present invention fastened in a user's hair style in an alternative manner.

The hair retainer 10 can alternatively be used to anchor hair by using the annular shaped tubular cloth band 12 in the manner of conventional elastic hair bands. The combs 14 and 16 are then used to secure the annular shaped tubular cloth band 12 to the user's hair 50. As seen in FIGS. 7 and 8, gathered strands of hair 52 extends through the central opening 54 of the annular band shaped tubular 12 which can be wrapped around several times until the desired tightness is achieved. The combs 14 and 16 are then reoriented with their teeth directed inward toward the scalp so that they encompass the hair 56 located between the annular shaped tubular cloth band 12 and the user's scalp. The hair retainer 10 can be used in a variety of stylings, such as the ponytail, a french roll or french braid to name a few designs. The combs are substantially hidden from view when in use.

This invention has been described herein in considerable detail in order to comply with the patent statutes and to provide those skilled in the art with the information needed to apply the novel principles and to construct and use such specialized components as are required. However, it is to be understood that the invention can be carried out by specifically different equipment and devices, and that various modifications, both as to the equipment and details and operating procedures, can be accomplished without departing from the scope of the invention itself.

I claim:

1. A decorative hair retainer comprising:

(a) an endless cloth tube having an outer peripheral surface and an inner closed passageway;

(b) an endless elastic band located within said inner closed passageway of said endless cloth tube;

(c) a first comb positioned on said outer peripheral surface of said endless cloth tube; and (d) a second comb positioned approximately 180° from said first comb on said outer peripheral surface of said endless cloth tube.

2. The decorative hair retainer of claim 1 wherein said first and second combs are secured to said endless cloth tube with an adhesive.

3. A decorative hair retaining device comprising:

(a) an annular band formed by joining opposed ends of an elongated cloth tube having an inner closed passageway, said annular band defining an inner circumferential surface and an outer circumferential surface;

(b) an elastic annular band located within said inner closed passageway adjacent said inner circumferential surface;

(c) a first comb secured to said outer circumferential surface; and (d) a second comb secured to said outer circumferential surface at a location spaced apart from said first comb.

4. The decorative hair retainer of claim 3 and wherein said second comb is secured approximately 180° around said outer circumferential surface from said first comb.

5. The decorative hair retainer of claim 3 wherein said first and second combs are secured to said elongated cloth tube with an adhesive.

6. The decorative hair retainer of claim 3 wherein said elastic band is approximately 11¼ inches in length and said elongated cloth tube is 2⅛ inches in width and 15 inches in length.

* * * * *